US005392737A

United States Patent [19]

Newman, Sr. et al.

[11] Patent Number: 5,392,737

[45] Date of Patent: Feb. 28, 1995

[54] FRICTION HEATER

[76] Inventors: William E. Newman, Sr., Apt. 2D, 206 Midlass Dr., Baltimore, Md. 21220-3733; Henry W. Clark, Jr., 5801 Deep Water Dr., Oxford, Md. 21654

[21] Appl. No.: 258,182

[22] Filed: Jun. 10, 1994

[51] Int. Cl.[6] ..... A24C 9/00

[52] U.S. Cl. ..... 122/26; 126/247; 237/116

[58] Field of Search ..... 122/26; 126/247; 237/1 R

[56] References Cited

U.S. PATENT DOCUMENTS

| | | | |
|---|---|---|---|
| 540,833 | 6/1895 | Guillot . | |
| 1,713,502 | 5/1929 | Steps . | |
| 1,718,175 | 6/1929 | Nilson . | |
| 1,768,716 | 7/1930 | Shishkoff . | |
| 2,090,873 | 8/1937 | Lazarus | 126/247 |
| 4,004,553 | 1/1977 | Stenstrom . | |
| 4,277,020 | 7/1981 | Grenier | 126/247 X |
| 4,312,322 | 1/1982 | Frihage . | |
| 4,387,701 | 1/1983 | Gibbons . | |
| 4,424,796 | 1/1984 | Fish . | |
| 4,454,861 | 6/1984 | Grenier . | |
| 4,501,231 | 2/1985 | Perkins . | |
| 4,554,906 | 11/1985 | Newman, Sr. et al. . | |
| 4,596,209 | 6/1986 | Haslach, Jr. . | |
| 4,721,066 | 1/1988 | Newman, Sr. et al. . | |
| 5,279,262 | 1/1994 | Muehleck | 122/26 |

FOREIGN PATENT DOCUMENTS

| | | |
|---|---|---|
| 286747 | 12/1914 | Germany . |
| 2927659 | 1/1981 | Germany . |
| 2420 | of 1854 | United Kingdom . |

*Primary Examiner*—Edward G. Favors
*Attorney, Agent, or Firm*—Young & Thompson

[57] ABSTRACT

A friction heater is provided which includes a rotor which rotates relative to a stator to generate heat which is transferred to a wall of a tank which contains a quantity of liquid to be heated. The outer surface of the stator and a surface of the tank are smooth surfaces which are in contact with each other substantially throughout their extent so that virtually no heat is lost at the interface between such surfaces. Baffles are provided in the tank to increase the dwell time of the liquid flowing through the tank.

18 Claims, 3 Drawing Sheets

FRICTION HEATER

BACKGROUND OF THE INVENTION

1. Field of the Invention

The present invention relates to a friction heater which includes a male rotor which is inserted into a female stator. Rotation of the rotor produces friction which heats the rotor and stator as well as an enclosed reservoir housing which extends around the periphery of the stator such that liquid contained within the housing is heated.

2. Description of Prior Art

It is well known in the art to use friction to produce heat to heat a liquid. For example, U.S. Pat. No. 4,554,906 to Newman, Sr. et al. relates to a system which includes a cylindrical rotary member which has an outer surface which engages a complimentary surface of a liner into which the rotary member extends. The friction caused by the rotation of the rotary member relative to the surface of the liner generates heat in the liner which in turn heats liquid contained in tanks disposed adjacent the liner. Adjustment means are provided to adjust the contact between the rotary member and the liner.

Another known prior art patent is U.S. Pat. No. 4,721,066 to Newman, Sr. et al. which describes a friction heater which includes a rotating drum housing in the shape of a truncate cone having an external surface which engages a bore surface of a housing, such bore surface having the same conical dimension as the external surface of the truncate cone. An external surface of the housing includes a helical groove coaxially around it, and wound around the helical groove is copper tubing. The friction caused by the rotation of the rotary drum relative to the bore surface generates heat in the housing which in turn heats liquid flowing through the copper tubing. In such apparatus it is difficult to maintain intimate contact between the copper tubing and the surface of the helical groove and consequently there tends to be heat loss at the interface between the tubing and the groove. In addition, the quantity of the liquid flowing through the tubing is not very great due to the limited volume of the tubing.

It is an object of the present invention to provide an improved friction heater.

It is a further object of the present invention to provide a friction heater wherein heat is more efficiently transferred from a stationary stator to an adjacent wall of an enclosed reservoir housing which contains a liquid to be heated without loss of heat at the interface between the stator and the wall.

It is yet another object of the present invention to provide a friction heater wherein means is provided to increase the dwell time of a liquid flowing through an enclosed reservoir housing wherein the liquid is being heated.

SUMMARY OF THE INVENTION

This invention achieves these and other results by providing a friction heater comprising a rotor and a stator into which the rotor extends. An outer surface of the rotor engages an inner surface of the stator. Means are attached to the rotor for rotating the rotor about a stator axis. An enclosed reservoir housing is provided having at least one inner wall, and at least one outer wall, which extend from a top wall to a bottom wall. The inner wall encloses a central area of the enclosed reservoir housing and the stator extends into such central area such that a smooth outer surface of the stator engages a smooth outer surface of the inner wall. A divider is disposed within the enclosed reservoir housing, the divider extending from the outer wall to the inner wall and from the top wall to the bottom wall to prevent the flow of liquid within the enclosed reservoir housing past the divider. A plurality of baffle plates is positioned in the enclosed reservoir housing. Each baffle plate extends from the outer wall to the inner wall. Alternate baffle plates extend from the top wall to a distance from the bottom wall. Baffle plates are also provided adjacent the alternate baffle plates and extend from the bottom wall to a distance from the top wall. An inlet extends through the outer wall into the enclosed reservoir housing adjacent one side of the divider. Similarly, an outlet extends through the outer wall into the enclosed reservoir housing adjacent an opposite side of the divider.

BRIEF DESCRIPTION OF THE DRAWINGS

This invention may be clearly understood by reference to the attached drawings in which.

DESCRIPTION OF THE PREFERRED EMBODIMENT

Figure 1:
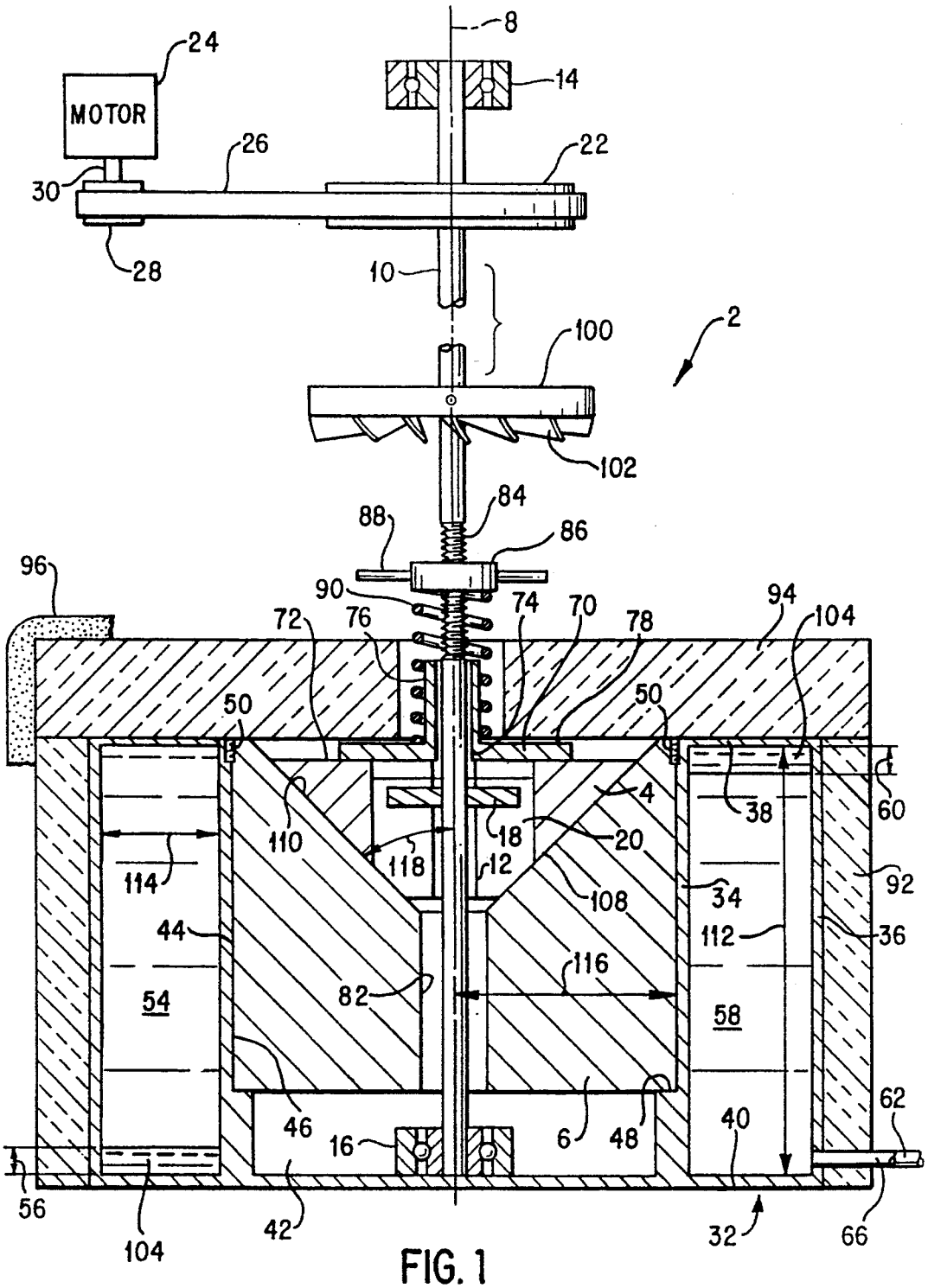
FIG. 1 is a view of a friction heater of the present invention partially in cross-section.
Figure 2:
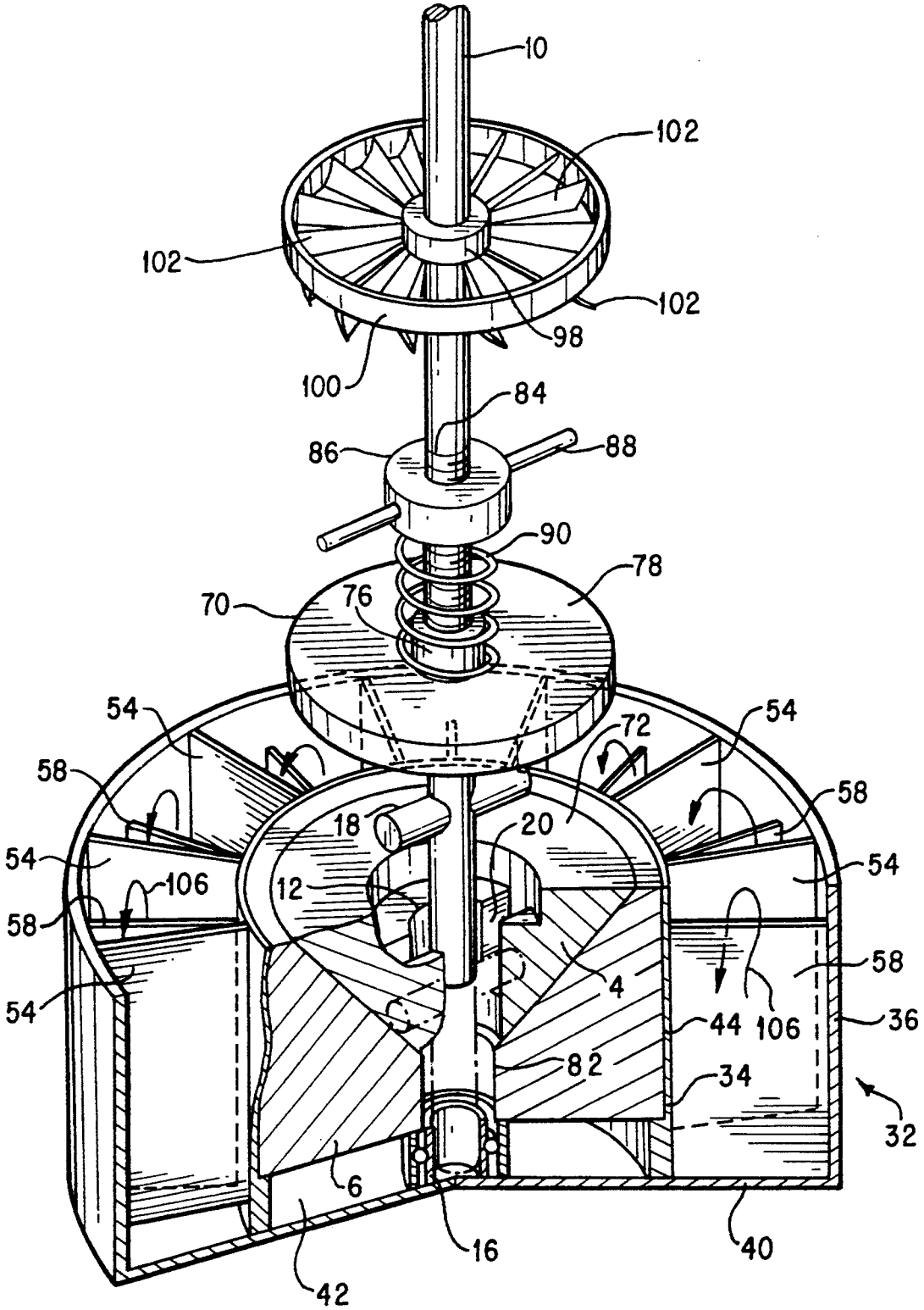
FIG. 2 is an exploded perspective view of a portion of the friction heater of FIG. 1.
Figure 3:
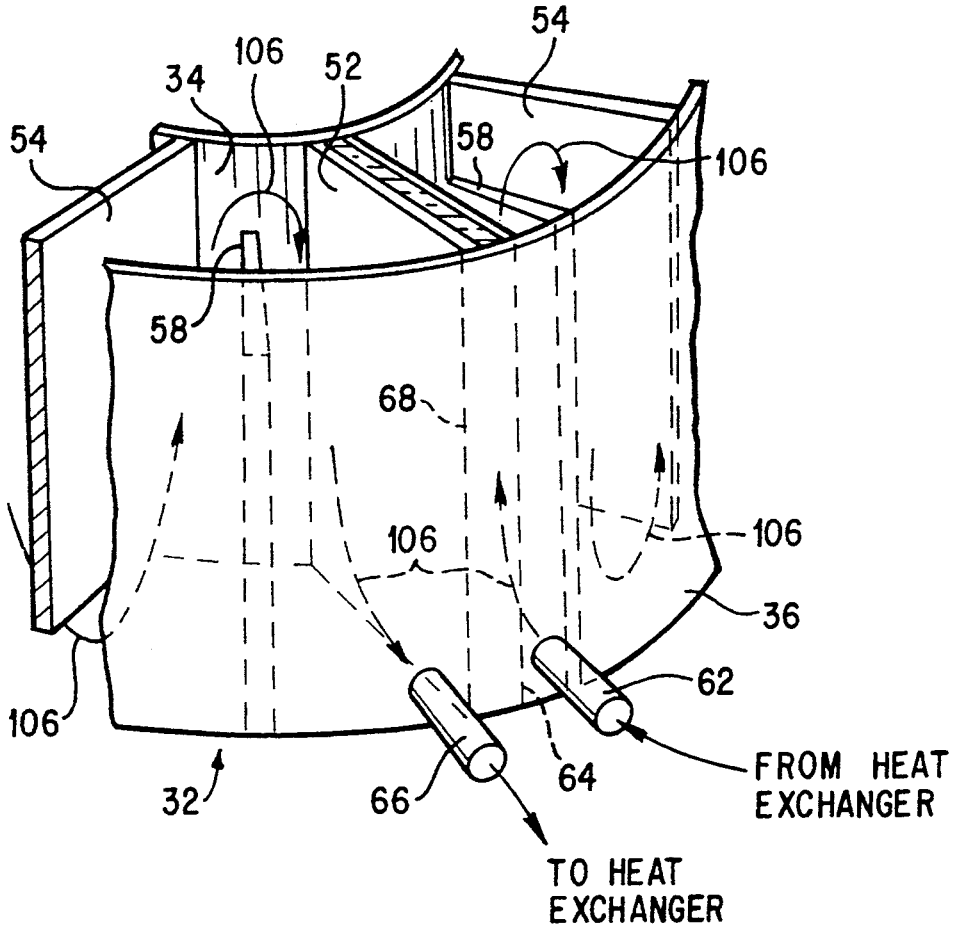
FIG. 3 is a perspective view of a portion of the enclosed reservoir housing of FIGS. 1 and 2.

The embodiment of this invention which is illustrated in FIGS. 1 to 3 is particularly suited for achieving the objects of this invention. FIG. 1 depicts a friction heater 2 which includes a rotor 4 and a stator 6. Preferably, rotor 4 and stator 6 are fabricated from cast iron. Means is provided attached to the rotor 4 for rotating the rotor about a stator axis 8. For example, in the embodiment depicted in the drawings, a shaft 10 extends through a bore 12 in the rotor 4 and is mounted at opposite ends to bearings 14 and 16. A rod 18 extends through the shaft 10 and is positioned within a slot 20 in the rotor 4. A pulley 22 is attached to an end of the shaft 10 and is operatively connected to a motor 24 by means of a belt 26 which extends between a motor pulley 28 and pulley 22. In a preferred embodiment, motor 24 is a 5 horsepower, 3 phase, 1500 rpm AC electric motor and belt 26 is a conventional gear belt. By providing a pulley 28 having a 3 inch diameter and a pulley 22 having a 19 inch diameter, the shaft 10 will rotate at about 700 rpm. In operation, energization of motor 24 rotates the motor shaft 30 and pulley 28 such that belt 26 rotates pulley 22 which rotates shaft 10 and rod 18 attached thereto. Rod 18 bears against the walls of slot 20 to rotate rotor 4 about rotor axis 8 as described in U.S. Pat. No. 4,721,066 referred to above.

Friction heater 2 also comprises an enclosed reservoir housing 32 which includes at least one inner wall 34 and at least one outer wall 36. Walls 34 and 36 extend from a top wall 38 to a bottom wall 40 as depicted in FIG. 1. In the preferred embodiment the enclosed reservoir housing 32 is fabricated from steel and is annular in shape, wall 34 comprising an inner cylindrical wall and wall 36 comprising an outer cylindrical wall. The inner wall 34 encloses a central area 42 of the enclosed reservoir housing 32. The stator 6 extends into the central area 42 such that a smooth outer surface 44 of the stator engages a smooth outer surface 46 of the inner wall 34. In particular, the stator 6 rests upon a flange 48 extending from inner wall 34. In the preferred embodiment, the stator 6 is held in place upon flange 48, relative to the enclosed reservoir housing 32, by means of a plurality of set screws 50 which extend into openings at the interface of surfaces 44 and 46 at the top surface 38.

With reference to FIG. 3 a divider 52 is provided within the enclosed reservoir housing 32. In particular divider 52 extends radially relative to axis 8 from outer wall 36 to inner wall 34 and in the direction of axis 8 from top wall 38 to bottom wall 40. For clarity in the drawing, top wall 38 and bottom wall 40 are not shown in FIG. 3. Divider 52 is sealingly attached to walls 34, 36, 38 and 40 so that divider 52 provides a liquid impermeable barrier as described in more detail hereinafter, which serves to prevent the flow of liquid within the enclosed reservoir housing 32 past the divider.

It will be apparent to those skilled in the art that the material and shape of the enclosed reservoir housing 32 are not limited to steel and an annular configuration. For example, and without limitation, housing 32 may be in the form of a cube having a central opening extending therethrough. The housing 32 may also be fabricated from some other material.

A plurality of baffle plates are positioned in the enclosed reservoir housing 32. For example, a first plurality of alternating baffle plates 54 extend in the direction of axis 8 from the top wall 38 to a distance 56 from the bottom wall 40. In addition, a second plurality of baffle plates 58, which are adjacent respective baffle plates 54, extend in the direction of axis 8 from bottom wall 40 to a distance 60 from top wall 38. Like divider 52, baffle plates 54 and 58 extend radially relative to axis 8 from outer wall 36 to inner wall 34. Baffle plates 54 and 58 are sealingly attached to walls 34, 36, 38 and 40, except where respective baffle plates are spaced from top wall 38 or bottom wall 40 at 60 and 56, to allow liquid to flow within the enclosed reservoir housing 32 as described hereinafter. In the preferred embodiment, baffles 54 and 58 are circumferentially spaced from one another an equal distance.

An inlet in the form of conduit 62 extends through outer wall 36 into the enclosed reservoir housing 32 adjacent one side 64 of divider 52, and an outlet in the form of conduit 66 extends through outer wall 36 into the enclosed reservoir housing adjacent an opposite side 68 of the divider, as depicted in FIG. 3.

In the preferred embodiment, a plate 70 is provided. Plate 70 engages a top surface 72 of the rotor 4 as shown in FIG. 1. Means is provided engaging plate 70 for urging plate 70 in the direction of axis 8 against the top surface 72 to stabilize the rotor 4. In particular, plate 70 includes a bore 74 which extends through the plate and a flange 76 which extends from surface 78 of the plate. Shaft 10 extends in the direction of axis 8 through bore 74, bore 12 which extends through the rotor 4 and a bore 82 which extends through stator 6. Shaft 10 includes threads 84, and a nut 86 having handles 88 and internal threads (not shown) is threaded upon such threads 84. Shaft 10 extends through a steel helical compression spring 90 which is positioned between the nut 86 and plate 70. Spring 90 is positioned about flange 76 as depicted in FIG. 1. In use, screwing the nut 86 relative to threads 84 in a first direction will increase the compression provided by spring 90 against plate 70 and screwing the nut in the opposite direction will decrease such compression. In this manner, the degree to which the plate 70 is urged against the top surface 72 of the rotor 4 may be controlled. In the preferred embodiment, nut 86 is adjusted so that spring 90 exerts a force of about 50 psi against plate 70. Preferably, the diameter of bore 74 is greater than the diameter of the shaft 10 to provide a slip fit between the plate 70 and the shaft.

In the preferred embodiment, the friction heater 2 may include an outer housing including wall 92 and cover 94 which may be fabricated from steel. To reduce the escape of heat, the wall 92 and cover 94 may be covered with an outer insulative material 96. In order to reduce the complexity of the drawings wall 92, cover 94 and insulative material 96 are only depicted in FIG. 1.

In the preferred embodiment, in order to prevent the pulley 22 and belt 26 from becoming to hot, the friction heater 2 may include a heat sink attached to shaft 10 at a distance from plate 70. For example, in the embodiment depicted in the drawings a heat sink is provided which includes a hub 98 fastened to shaft 10 at a distance from plate 70, and a rim portion 100 spaced radially relative to the hub. At least one fin 102 extends between and is attached to the hub 98 and rim portion 100. In the embodiment of FIGS. 1 and 2, there is a plurality of fins 102 each of which is angled in the direction of rotation at about 45° relative to axis 8 as depicted in FIG. 1. In the preferred embodiment the hub, rim portion and fins are fabricated from aluminum and the rim portion has a diameter of about 15".

In operation of the friction heater 2, the enclosed reservoir housing 32 will contain a substantial volume of liquid 104 such as a 50/50 solution of water and antifreeze. Conduit 62 may be connected to an outlet of a heat exchanger (not shown) and conduit 66 may be connected to an inlet of such heat exchanger. A pump (not shown) will typically be provided for pumping the liquid 104 through the heat exchanger and into and out of the enclosed reservoir housing at conduits 62 and 66, respectively. In an alternative embodiment the friction heater 2 may be connected to a hot water system where cold water enters conduit 62 and heated water exits at conduit 66 as described herein.

The liquid 104 pumped through the enclosed reservoir housing 32 will follow a serpentine flow path designated by arrows 106. In particular in the embodiment of the drawings, the liquid will flow in a counterclockwise direction from inlet conduit 62 to outlet conduit 66. During such flow, the liquid will flow upward and downward relative to the alternate baffles 54, 58 as the liquid flows over the top of each baffle 58 at the opening provided at 60 and under the bottom of each baffle 54 at the opening provided at 56. Such serpentine flow is best shown in FIG. 3. The presence of the baffles 54, 58 will tend to increase the amount of time it takes the liquid to flow from inlet conduit 62 to outlet conduit 66.

In order to heat the liquid 104, motor 24 is energized to cause the rotor 4 to rotate relative to the stator 6 as described above, the outer surface 108 of the rotor 4 engaging the inner surface 110 of the stator 6 to generate friction which heats the mass of the stator throughout. Without being bound by a theory of operation, it is believed that the heat of the stator 6 heats inner wall 34 of the enclosed reservoir housing 32, the heated stator 6 and inner wall 34 expanding to the extent that there is substantially no space between smooth surfaces 44 and 46. In the preferred embodiment, inner wall 34 will be about ¾ inch. In essence, the stator 6 and inner wall 34 act as a single mass to the extent that the temperature of the inner wall 34 will rise to be substantially equal to the temperature of the rotor 6 with virtually no heat loss at the interface between the two. By providing the rotor 4, stator 6 and enclosed reservoir housing 32 as a single unit, a large volume of liquid 104 may be heated by the inner wall 34 to a temperature substantially equal to the temperature of the rotor 4 and stator 6. In a preferred embodiment, the enclosed reservoir housing has a height 112 of about 18 inches, a width 114 of about 10 inches, a radius 116 of about 6 inches, and contains about 41 gallons of liquid 104.

In the preferred embodiment the rotor 4 is a truncated cone and the inner surface 110 of the stator comprises a surface area which conforms to the truncated cone as depicted in FIGS. 1 and 2. Preferably, the outer surface 108 of the truncated cone is oriented at an angle 118 relative to the stator axis 10 of about 35° to 45° it being believed that an angle 118 of 40° is particularly efficient.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

I claim:

1. A friction heater comprising:

a rotor;

a stator into which said rotor extends, an outer surface of said rotor engaging an inner surface of said stator;

means attached to said rotor for rotating said rotor about a stator axis;

an enclosed reservoir housing having at least one inner wall, and at least one outer wall, which extend from a top wall to a bottom wall, said at least one inner wall enclosing a central area of said enclosed reservoir housing, said stator extending into said central area such that a smooth outer surface of said stator engages a smooth outer surface of said inner wall;

a divider disposed within said enclosed reservoir housing, said divider extending from said outer wall to said inner wall and from said top wall to said bottom wall to prevent the flow of liquid within said enclosed reservoir housing past said divider;

a plurality of baffle plates positioned in said enclosed reservoir housing and extending from said outer wall to said inner wall, alternate baffle plates extending from said top wall to a distance from said bottom wall, and baffle plates adjacent said alternate baffle plates extending from said bottom wall to a distance from said top wall;

an inlet extending through said outer wall into said enclosed reservoir housing adjacent one side of said divider; and an outlet extending through said outer wall into said enclosed reservoir housing adjacent an opposite side of said divider.

2. The friction heater of claim 1 wherein said rotor is a truncated cone and said inner surface of said stator comprises a surface area having a configuration which conforms to said truncated cone.

3. The friction heater of claim 2 wherein said truncated cone includes an outer surface having an angle relative to said stator axis of about 35° to 45°.

4. The friction heater of claim 3 wherein said angle is 40°.

5. The friction heater of claim 2 further including a first plate which engages a top surface of said rotor and means engaging said first plate for urging said first plate against said top surface of said rotor to stabilize said rotor.

6. The friction heater of claim 5 wherein said rotating means includes a shaft which extends along said stator axis through a first bore in said first plate and a second bore in said rotor, the diameter of said first bore being greater than the diameter of said shaft to provide a slip fit between said first plate and said shaft.

7. The friction heater of claims 1 further including an outer insulative material into which said rotor, said stator and said enclosed reservoir housing are disposed.

8. The friction heater of claim 6 further including a heat sink attached to said shaft at a distance from said plate.

9. The friction heater of claim 8 wherein said heat sink comprises a hub fastened to said shaft and a rim portion spaced radially relative to said hub, at least one fin extending between and attached to said hub and said rim portion.

10. The friction heater of claim 9 wherein said at least one fin comprises a plurality of fins.

11. A friction heater comprising an annular enclosed housing having a central open area defined by a heat transfer wall having a smooth outer surface, a stator disposed within said central open area providing a smooth first heat transfer surface and an opposite smooth second heat transfer surface, said first heat transfer surface being substantially entirely in intimate contact with said smooth outer surface, a rotor coaxially disposed relative to said annular enclosed housing and said stator and providing a smooth third heat transfer surface substantially entirely in intimate contact; with said second heat transfer surface, means for rotating said rotor relative to said stator, a divider provided within and sealingly attached to said annular enclosed housing for preventing 360° flow of liquid in said annular enclosed housing, an inlet extending into said annular enclosed housing and located circumferentially on one side of said divider, an outlet extending into said annular enclosed housing and located circumferentially on an opposite side of said divider, and at least one baffle plate positioned within said annular enclosed housing and located in a flow path of any liquid flowing through said annular enclosed housing from said inlet to said outlet.

12. The friction heater of claim 11 wherein said rotor is a truncated cone.

13. The friction heater of claim 12 wherein said truncated cone includes said third heat transfer surface extending at an angle relative to a stator axis of about 35° to 45°.

14. The friction heater of claim 13 wherein said angle is 40°.

15. The friction heater of claim 11 wherein said rotating means includes a heat sink.

16. The friction heater of claim 13 wherein said rotating means includes a shaft, and further including a heat sink attached to said shaft.

17. The friction heater of claim 16 wherein said heat sink comprises a hub fastened to said shaft and a rim portion spaced radially relative to said hub, at least one fin extending between and attached to said hub and said rim portion.

18. The friction heater of claim 17 wherein said at least one fin comprises a plurality of fins.

* * * * *